US007270308B1

(12) United States Patent
Mohr

(10) Patent No.: US 7,270,308 B1
(45) Date of Patent: Sep. 18, 2007

(54) IMPLEMENT RETAINING AND UTILITY TRAY DEVICE

(76) Inventor: Joyce M. Mohr, 1108 New York Ave., Absecon, NJ (US) 08201

( * ) Notice: Subject to any disclaimer, the term of this patent is extended or adjusted under 35 U.S.C. 154(b) by 0 days.

(21) Appl. No.: 11/652,413

(22) Filed: Jan. 11, 2007

Related U.S. Application Data

(63) Continuation-in-part of application No. 10/789,730, filed on Feb. 27, 2004, now abandoned.

(51) Int. Cl.
*A47F 5/00* (2006.01)

(52) U.S. Cl. ..... 248/309.1; 248/918

(58) Field of Classification Search ..... 248/309.1, 248/205.1, 118, 118.1, 918; 281/42; D19/81, D19/83; 24/10 R, 12
See application file for complete search history.

(56) References Cited

U.S. PATENT DOCUMENTS

| | | | | |
|---|---|---|---|---|
| 155,196 | A | | 9/1874 | McNair |
| 1,226,992 | A | | 5/1917 | Paulus |
| 1,650,070 | A | | 11/1927 | Hansman et al. |
| 2,202,267 | A | | 5/1940 | Posnack |
| 2,300,216 | A | | 10/1942 | Grodsky et al. |
| D168,491 | S | | 12/1952 | Alvarez |
| 3,105,279 | A | | 10/1963 | Westhoff |
| D228,239 | S | | 8/1973 | Bryce |
| 4,204,097 | A | | 5/1980 | Schmit |
| 4,984,529 | A | | 1/1991 | Dickson |
| 5,050,830 | A | | 9/1991 | Hall |
| 5,467,952 | A | * | 11/1995 | Martin ..... 248/118.1 |
| 5,572,941 | A | | 11/1996 | Arnos |
| 5,725,189 | A | | 3/1998 | Landy |
| 5,794,905 | A | | 8/1998 | Richter |
| 5,820,095 | A | | 10/1998 | Stone |
| 6,409,404 | B1 | | 6/2002 | Piech |
| 6,477,744 | B1 | | 11/2002 | Miles |
| 2002/0036253 | A1 | | 3/2002 | Lake |

* cited by examiner

*Primary Examiner*—Korie Chan

(57) ABSTRACT

A implement retaining device for inhibit writing implements from rolling freely across a support surface. The implement retaining device includes a body member being designed for being positioned on a support surface whereby the body member is designed for having a portion of the body member slid under an object positioned on the support surface. The body member is designed for receiving the writing implements whereby the body member is for inhibiting the writing implements from rolling across the support surface.

2 Claims, 4 Drawing Sheets

IMPLEMENT RETAINING AND UTILITY TRAY DEVICE

REFERENCE TO RELATED APPLICATION

This application is a continuation-in-part of my patent application Ser. No. 10/789,730, filed Feb. 27, 2004 now abandoned.

BACKGROUND OF THE INVENTION

1. Field of the Invention

The present invention relates to holder devices and more particularly pertains to a new implement retaining device for inhibit writing implements from rolling freely across a support surface.

2. Description of the Prior Art

The use of holder devices is known in the prior art. U.S. Pat. No. 5,820,095 describes a device for clipping around a portion of a writing implement to inhibit the writing implement rolling freely on a surface. Another type of holder device is U.S. Pat. No. 5,794,905 having a holder with a jaw for clamping around a portion to the writing implement to secure the implement to the holder. U.S. Pat. No. 6,409,404 has a pen that is inserted into sheath like holder so that the pen is completely surrounded by the holder.

While these devices fulfill their respective, particular objectives and requirements, the need remains for a device that has certain improved features that allow the writing implement to be easily retrieved from the device without extensive manipulation of the writing implement.

SUMMARY OF THE INVENTION

The present invention meets the needs presented above by body member with a base portion and a retention portion with the retention being for inhibiting the writing implements rolling off of the body member when the writing implements are positioned on the body member.

Still yet another object of the present invention is to provide a new implement retaining device that allows writing implements to be maintained in a convenient location that can be readily located by the user.

Even still another object of the present invention is to provide a new implement retaining device that inhibits writing implements from rolling off of the support surface and being lost.

To this end, the present invention generally comprises a body member being designed for being positioned on a support surface whereby the body member is designed for having a portion of the body member slid under an object positioned on the support surface. The body member is designed for receiving the writing implements whereby the body member is for inhibiting the writing implements from rolling across the support surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
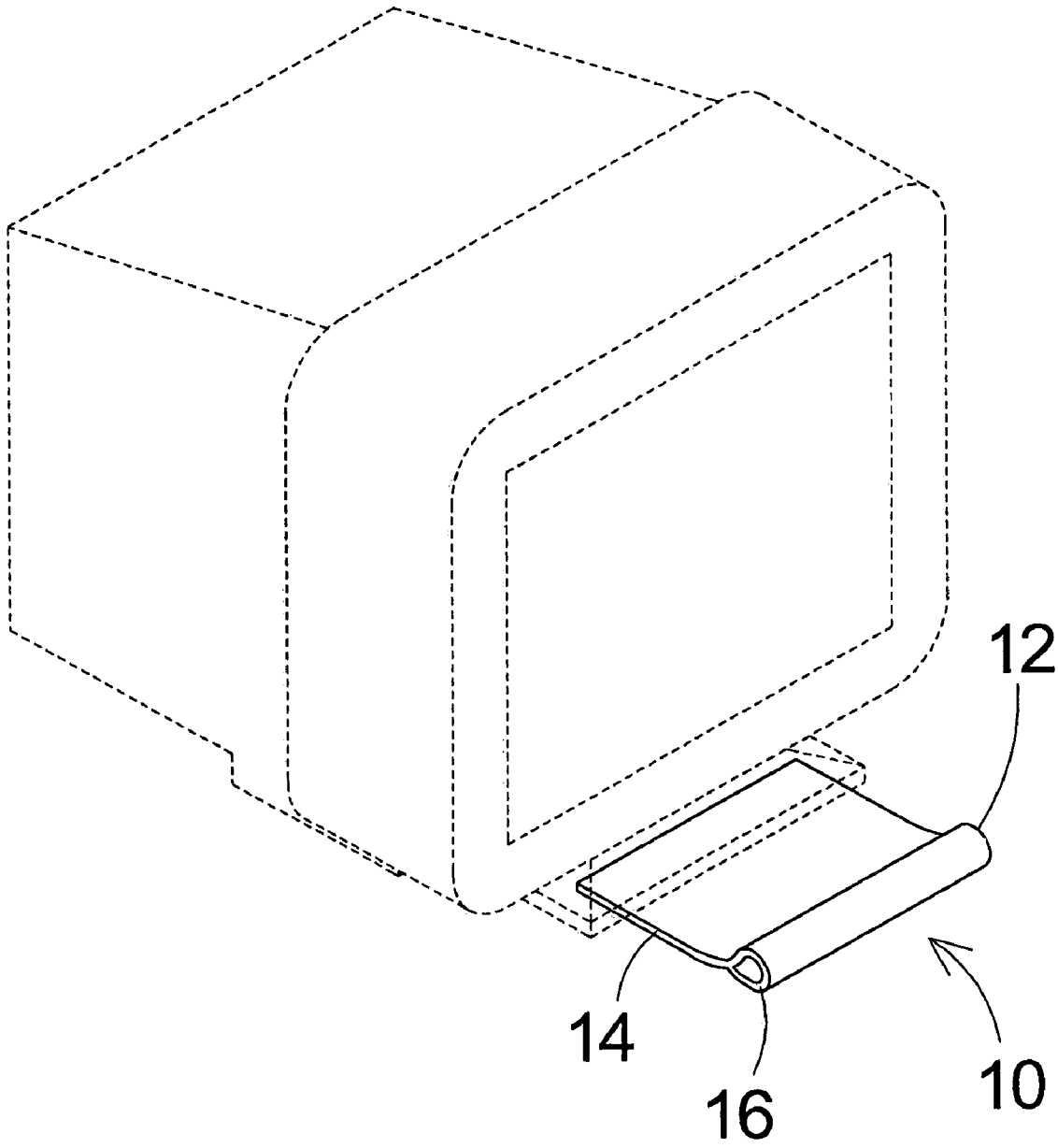
FIG. 1 is a perspective view of a new implement retaining device according to the present invention shown in use.

With reference now to the drawings, and in particular to FIGS. 1 through 4 thereof, a new implement retaining device embodying the principles and concepts of the present invention and generally designated by the reference numeral 10 will be described.

Figure 2:
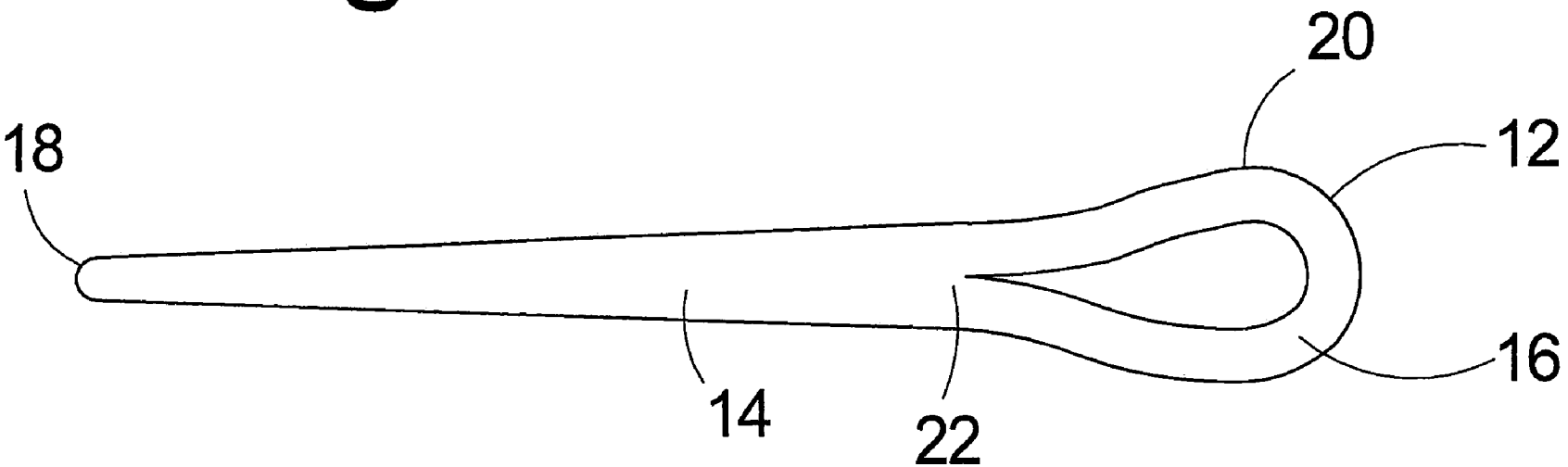
FIG. 2 is a side view of the present invention.

As best illustrated in FIGS. 1 through 2, the implement retaining device 10 generally comprises a body member 12 being designed for being positioned on a support surface whereby the body member 12 is designed for having a portion of the body member 12 slid under an object, such as a computer monitor or a telephone, positioned on the support surface. The body member 12 is designed for receiving the writing implements whereby the body member 12 is for inhibiting the writing implements from rolling across the support surface.

The body member 12 comprises a base portion 14 and a retention portion 16. The retention portion 16 is coupled to the base portion 14. The base portion 14 is designed for being positioned under the object whereby the retention portion 16 extends outwardly from the object. The retention portion 16 is designed for inhibiting the writing implements from inadvertently rolling off of the body member 12 when the writing implements are placed on the body member 12 between the retention portion 16 of the body member 12 and the object positioned on the base portion 14 of the body member 12.

The base portion 14 of the body member 12 comprises a free end 18. The free end 18 is positioned opposite the retention portion 16 of the body member 12. The free end 18 is designed for being inserted between the object and the support surface whereby the base portion 14 is retained in a desired position by the weight of the object.

The base portion 14 tapers from the retention portion 16 to the free end 18 of the base portion 14 whereby the base portion 14 is substantially wedge shaped. The base portion 14 is designed for facilitating sliding of the base portion 14 under the object.

The retention portion 16 of the body member 12 has a width greater than a width of the base portion 14. The retention portion 16 extends outwardly from the base portion 14 whereby the retention portion 16 is designed for inhibiting the writing implements from rolling off the base portion 14 when the writing implements are positioned on the body member 12.

The retention portion 16 comprises an arcuate exterior surface 20. The arcuate exterior surface 20 is designed for providing a smooth surface along which one of the writing implements can be slid to retrieve one of the writing implements. The arcuate exterior surface 20 is designed for providing a smooth surface that is comfortable to a hand of a user retrieving one of the writing implements.

The arcuate exterior surface 20 of the retention portion 16 of the body member 12 forms a teardrop shape. The retention portion 16 comprises a narrow end 22 representing the narrow portion of the teardrop shape whereby the narrow end 22 is coupled to the base portion 14. The teardrop shape of the retention portion 16 provides a gradual incline whereby the teardrop shape of the retention portion 16 is designed for facilitating selectively sliding one of the writing implements alone the arcuate exterior surface 20 of the retention portion 16 by the user when the user removes one of the writing implements from the body member 12. As shown in FIG. 2, the retention portion may comprise a loop having a pair of opposite extents, with each of those opposite extents of said loop being united to said base portion.

Figure 3:
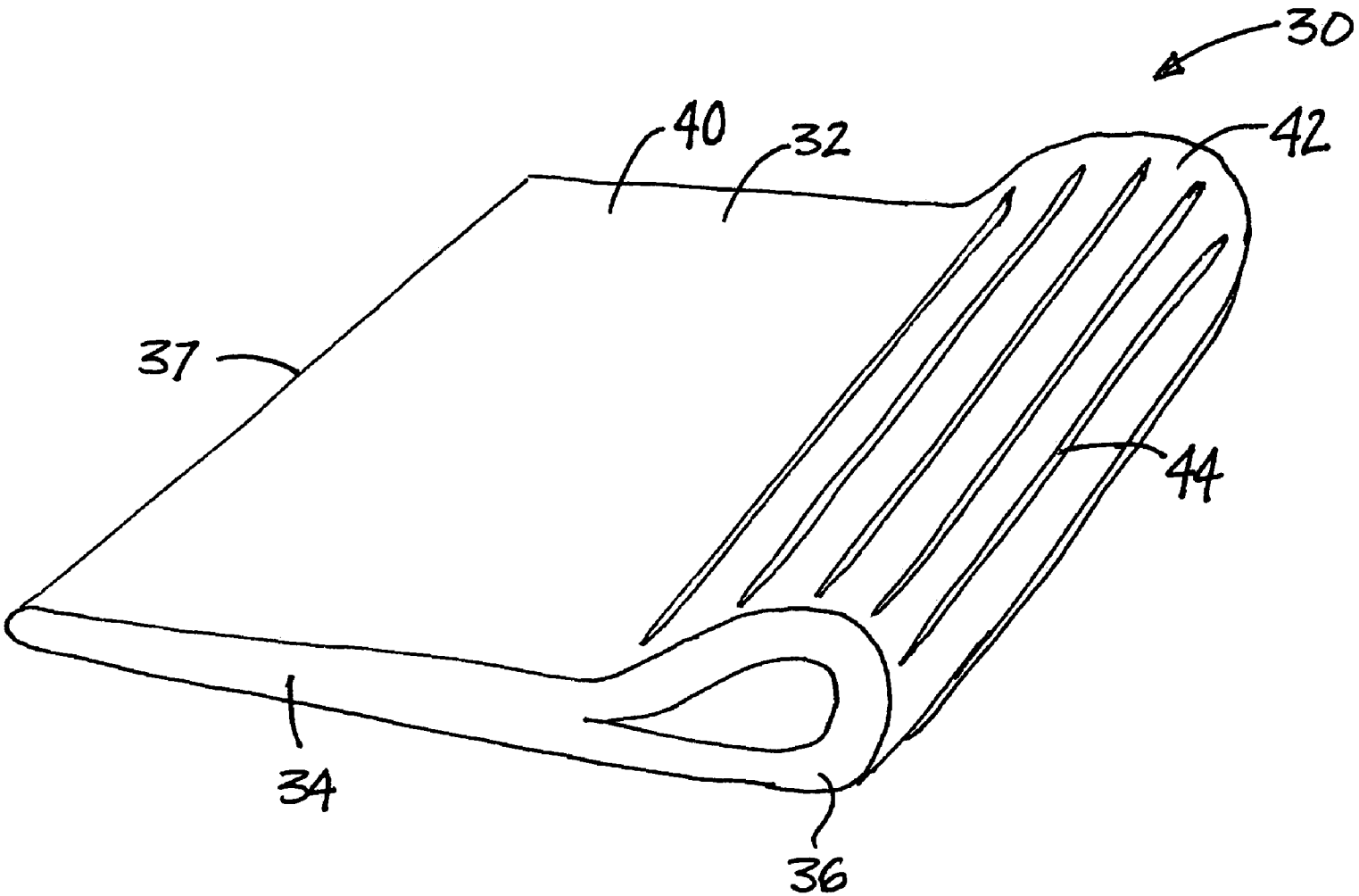
FIG. 3 is a perspective view of an embodiment of the present invention showing optional ribs on an outer surface.
Figure 4:
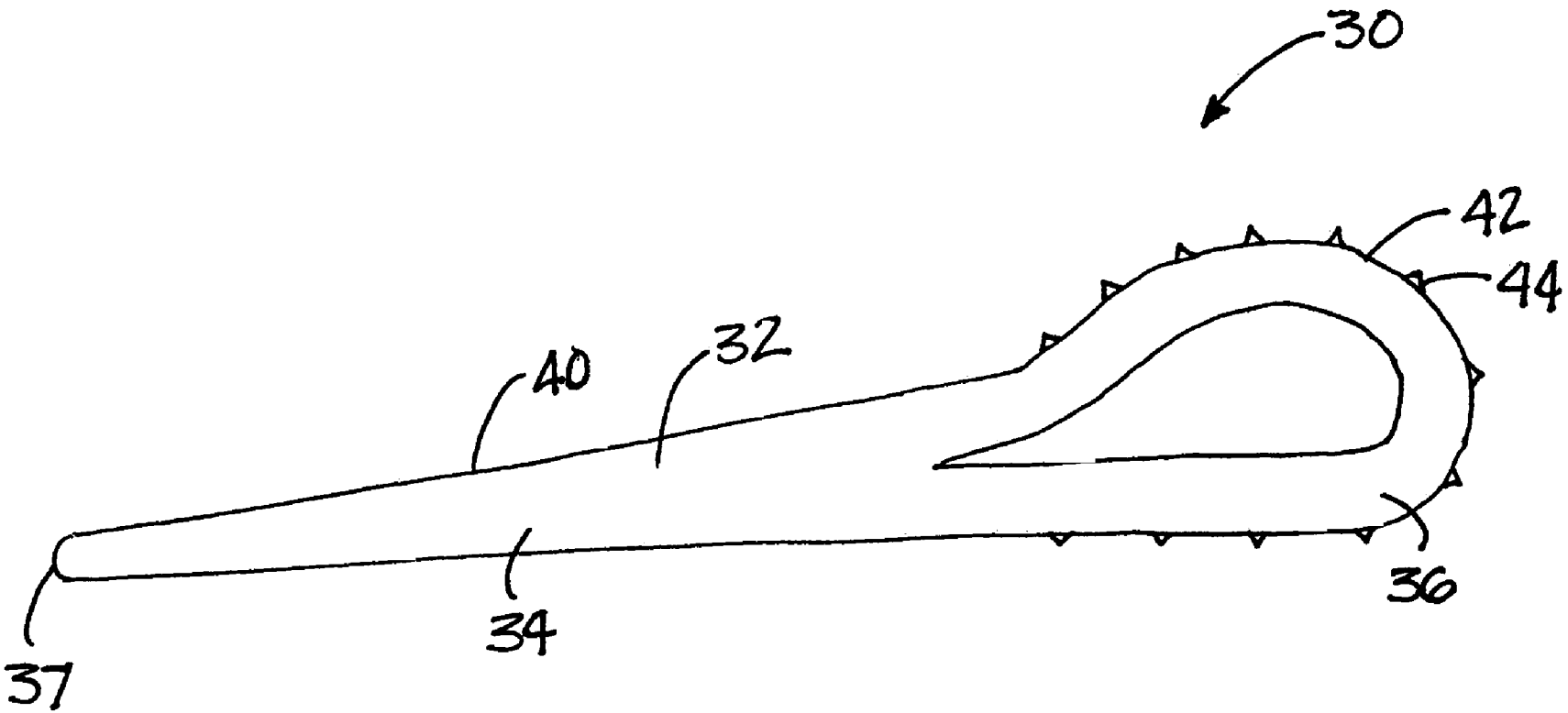
FIG. 4 is a side view of the embodiment of the present invention shown in FIG. 3.

As shown in FIGS. 3 and 4 of the drawings, an embodiment 30 of the device features a body member 32 with a base portion 34 and retention portion 36 with a free end 37. The device 30 has an exterior surface 38, and an upper portion 40 of the exterior surface 38 has a substantially concave contour forming an area or place for positioning items such as writing instruments, paper clips, tweezers, or any small item. Another portion 42 of the exterior surface 38 of the device is substantially convex, and may include one or more ribs 44 that extend substantially parallel to the free end 37. The ribs 44 provide the portion 42 of the exterior surface 38 of the device 30 with a corrugated or convoluted surface which enhances the grippability of the device 30 by the hand of a user, as well as providing some resistance to items resting on the surface from rolling off of the upper portion of the exterior surface.

In use, the user slides the free end 18 of the base portion 14 of the body member 12 under the object. The user can then place writing implements on the body member 12 so that the writing implements are positioned on the body member 12 between the retention portion 16 of the body member 12 and the object positioned on the base portion 14 of the body member 12. The retrieve one of the writing implements the user needs to only slide one of the writing implements along the arcuate exterior surface 20 of the retention portion 16 of the body member 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An implement retaining device for inhibiting writing implements from rolling away from a user, the implement retaining device comprising:

a body member for positioning on a support surface, said body member comprising a base portion for positioning under the object and a retention portion coupled to and extending outwardly from the base portion for inhibiting the writing implements from rolling off of said body member when the writing implements are placed on said body member between said retention portion of said body member and the object when the object is positioned on said base portion of said body member;

wherein said base portion comprises a free end positioned opposite of said retention portion for being inserted between the object and the support surface such that said base portion is retained in a desired position by the weight of the object; and wherein said base portion tapers thinner in thickness from said retention portion to said free end of said base portion such that said base portion is substantially wedge shaped to facilitate sliding of said base portion under the object;

wherein a portion of an exterior surface of said base portion and a portion of an exterior surface of said retention portion form a concave channel;

wherein a portion of the exterior surface of said retention portion is convex;

wherein a plurality of ribs are formed on the exterior surface of said retention portion, said ribs extending substantially parallel to said free end of said base portion;

wherein the concave portion and the convex portion of the exterior surface of said retention portion of said body member forms a teardrop shape, said retention portion comprising a narrow end representing the narrow portion of said teardrop shape, said narrow end being coupled to said base portion, said teardrop shape of said retention portion providing a gradual incline; and wherein said retention portion comprises a loop having a pair of opposite extents, each of the opposite extents of said loop being united to said base portion.

2. The implement retaining device of claim 1 wherein said retention portion of said body member has a width greater than a width of said base portion.

* * * * *